United States Patent [19]

Lukin et al.

[11] 4,240,829

[45] Dec. 23, 1980

[54] ALUMINUM-BASE ALLOY USED AS MATERIAL FOR GALVANIC PROTECTOR

[76] Inventors: Evgeny G. Lukin, ulitsa Dzhandosova, 69, kv. 123; Jury D. Dunaev, ulitsa Bagrationa, 15, kv. 2; Leonid F. Kozin, Sovetskaya ulitsa, 64, kv. 5; Raushan G. Sarmurzina, ulitsa Mira, 158, kv. 16; Svetlana E. Kozhirova, ulitsa 6 linia, 183-a, kv. 16; Ergali Ospanov, ulitsa Kotelnikova, 32-a; Irina F. Silukova, 7 mikroraion, 16 kv. 16, all of Alma-Ata, U.S.S.R.

[21] Appl. No.: 6,963

[22] Filed: Jan. 25, 1979

[51] Int. Cl.[3] ..... C22C 21/06

[52] U.S. Cl. ..... 75/147; 204/148; 204/197; 204/293

[58] Field of Search ..... 75/147, 138; 204/148, 204/197, 293

[56] References Cited

U.S. PATENT DOCUMENTS

| | | | |
|---|---|---|---|
| 4,098,606 | 7/1978 | Despic et al. | 75/138 |
| 4,107,406 | 8/1978 | Moden et al. | 75/147 |

*Primary Examiner*—R. Dean

*Attorney, Agent, or Firm*—Ladas & Parry

[57] ABSTRACT

An aluminum-base alloy used as the material for galvanic protector and consisting essentially of about 0.005 to about 3.5 weight percent gallium, about 0.1 to about 1.0 weight percent magnesium and the balance being essentially aluminum.

The alloy is made up of readily available components, affords effective corrosion protection to iron and steel when in contact with aqueous salt solutions of various concentration (from 10 mg/l to a saturated aluminum solution). The alloy exhibits high electrochemical properties, namely: a current density in natural water with a total concentration of salts ranging from 100 to 200 mg/l is 2 ma/dm$^2$, and in a saturated calcium sulfate is 10 ma/dm$^2$. The electrochemical activity of the alloy is smoothly regulated by the quantitative composition thereof.

1 Claim, No Drawings

ALUMINUM-BASE ALLOY USED AS MATERIAL FOR GALVANIC PROTECTOR

BACKGROUND OF THE INVENTION (a) Field of the Invention

The present invention pertains to alloys used as the material for galvanic protectors intended for employment in electrochemical corrosion protection of various articles, structures and constructions manufactured from iron and steel and employed in various aqueous environments, including underground environments.

(b) Description of the Prior Art

For example, there are known magnesium base alloys used as galvanic protectors and consisting essentially of 90 and more weight percent magnesium, the balance being zinc and aluminum (cf. *Physico-Chemical Mechanics of Materials,* 1973, No 6, pp. 76–79).

The above-mentioned alloys used as galvanic protectors are disadvantageous in that they are characterized by a low electrical output (about 1000 A.h/kg, which amounts to 50–60 percent of theoretical electrical output), and fails to afford effective corrosion protection to iron and steel due to the formation of oxide film on their surfaces, this resulting in passivation of the alloys as well as in lower potential of the protection current.

The prior art also teaches an aluminum base sacrificial anode, comprising 0.005 to 0.03 weight percent gallium (cf. Boshoku Gujutsu, 1974, No 4, pp. 191–195).

The aforementioned alloy sacrificial anode is effective when used in waters high in salts, for example, in seawater, and fails to ensure protection to iron and steel structures brought in contact with drinking water and soil water low in salts (up to 10 mg/l).

U.S. Pat. No. 3,878,081 discloses an aluminum sacrificial anode consisting essentially of 0.02 to about 2 weight percent bismuth, about 0.005 to 0.05 weight percent gallium, about 0.005 to about 0.5 weight percent indium, the balance being essentially aluminum.

The aluminum alloy sacrificial anode of the patent referred to above has insufficiently good electrochemical properties (a current density in a fresh water electrolyte with a resistivity of 5,000 ohm.cm is 10 ma/ft$^2$, and 50 ma/ft$^2$ in a saturated calcium sulfate electrolyte). In addition, the aluminum alloy composition includes difficulty available and expensive metals, such as indium, bismuth.

SUMMARY OF THE INVENTION

It is an object of the invention to provide an aluminum alloy to be used as the material for galvanic protector, which will exhibit good electrochemical properties.

Another object of the invention is to provide such aluminum-base alloy which will afford effective corrosion protection to iron and steel structures in various aqueous environments (having properties varying from those of saturated salt solutions to practically distilled water).

Still another object of the invention is to provide an aluminum-base alloy which will essentially consist of readily available components.

These and other objects of the invention are accomplished by the provision of an aluminum-base alloy to be used as the material for galvanic protector and consisting essentially of about 0.005 to 3.5 weight percent gallium, about 0.1 to 1.0 weight percent magnesium and the balance being essentially aluminum.

The alloy of the invention essentially consists of readily available components and affords effective corrosion protection to ferrous members when in contact with aqueous solutions of various salt concentrations (from 10 mg/l to a saturated solution), for example, in distilled water, river water, soil water and sea water. Thus, the alloy according to the invention is readily applicable for use in affording corrosion protection to underground constructions, to hulls of river and off shore boats, to various structures in sea oil fields; as well as to internal and external surfaces of various water heating and water supply systems.

The aluminum-base alloy according to the invention exhibits high electrochemical properties, namely: a current density in natural water with a total concentration of salts therein ranging from 100 to 200 mg/l is 2 ma/dm$^2$, and 10 ma/dm$^2$ in a saturated calcium sulfate solution.

The electrochemical activity of the aluminum-base alloy of the invention, as distinct from other magnesium and zinc galvanic anodes, are easily regulable by a quantitative composition of the alloy depending on the properties of the environment used (salt concentration, pH, etc.).

DETAILED DESCRIPTION OF THE INVENTION

The alloy of the invention is prepared in the following manner. A desired amount of aluminum is melted in a crucible or in any other suitable metal melting means. Then, the elements gallium and magnesium are introduced into the melt in sufficient amounts (depending on the properties of aqueous environment). After the gallium and magnesium are admixed with the molten aluminum to provide the desired alloy, the molten metal is cast into a suitable form or mold of a predetermined shape, whereby a galvanic protector of a desired shape and weight is produced.

To study protective properties of the aluminum-base alloy of the invention, galvanic protectors were manufactured therefrom in the form of rods having 4 to 5 mm in diameter and 10 cm$^2$ in surface area. Each of the galvanic protectors was connected by means of spring contacts with steel rods having 4 mm in diameter and 10 cm$^2$ in surface area. The resultant connected pairs were positioned in a cylindrical vessel of 200 milliliter in capacity, containing various aqueous environments, which were changed every other day. The steel rod was spaced from the galvanic protector within a distance of 5 cm. The temperature of the solutions contained in the vessel was maintained at 20° C.

The rate of steel corrosion (mg/cm$^2$ per day) in drinking water (dry residue being about 150 mg/l) was determined by means of calorimetric analysis on account of the amount of oxidized iron ($Fe^{++}$) which had passed into the water.

To compare the effectiveness of the protective properties of the aluminum-base alloy of the invention, protective properties of known aluminum-gallium and aluminum-magnesium alloys were tested in drinking water (dry residue being about 150 mg/l), as well as the rate of corrosion of the steel test pieces left without protection. Test results are given below in Table 1.

TABLE I

| Alloy composition | Rate of steel corrosion, mg/cm² per day — Test period, days 2 | 10 | 20 |
|---|---|---|---|
| Without using galvanic protector | 0.26 | 0.25 | 0.21 |
| 0.1 wt. % Mg; Al, the balance | 0.25 | 0.23 | 0.21 |
| 1.0 wt. % Mg; Al, the balance | 0.22 | 0.24 | 0.22 |
| 0.1 wt. % Ga; Al, the balance | 0.24 | 0.22 | 0.20 |
| 0.25 wt. % Ga; Al, the balance | — | 0.12 | 0.12 |
| 1.0 wt. % Ga; Al, the balance | 0.10 | 0.10 | 0.10 |
| 0.1 wt. % Ga; 0.1 wt. % Mg; Al, the balance | — | — | 0.14 |
| 0.1 wt. % Ga; 0.5 wt. % Mg; Al, the balance | — | — | 0.12 |
| 0.1 wt. % Ga, 1.0 wt. % Mg; Al, the balance | | | 0.10 |
| 1.0 wt. % Ga, 1.0 wt. % Mg, Al, the balance | 0.004 | 0.006 | 0.000 |

The rate of steel corrosion (mg/cm² per day) in salt solutions was determined gravimetrically on account of the total amount of the oxidized iron (see Table 2).

TABLE 2

| Concentration of NACl in water, mg/l | Rate of steel corrosion, mg/cm² per day — Alloy composition, wt. % — Without Sacrificial anode | Ga, 0.10 Mg, 1.000 Al, the balance | Ga, 3.5 Mg, 1.0 Al, the balance | Test period days |
|---|---|---|---|---|
| 6000 | 0.42 | 0.03 | — | 30 |
| 1000 | 0.35 | 0.04 | — | 30 |
| 10 | 0.28 | — | 0.05 | 40 |

As can be seen from the test data given in Tables I and 2, the aluminum-base alloy of the invention affords effective corrosion protection to iron and steel in a far wider variety of compositions of aqueous environments and has higher electrochemical properties as compared to other aluminum base alloys.

What is claimed is:

1. An electrochemically active aluminum base alloy consisting essentially of about 0.1 to 3.5 weight percent gallium, about 0.1 to 1.0 weight percent magnesium and the balance essentially aluminum.

* * * * *